US007566252B2

(12) United States Patent
Bolster

(10) Patent No.: US 7,566,252 B2
(45) Date of Patent: Jul. 28, 2009

(54) AQUATIC PROPULSION DEVICE FOR SWIMMERS

(76) Inventor: Brian Bolster, 5857 Chesbro Ave., San Jose, CA (US) 95123

( * ) Notice: Subject to any disclaimer, the term of this patent is extended or adjusted under 35 U.S.C. 154(b) by 0 days.

(21) Appl. No.: 12/057,089

(22) Filed: Mar. 27, 2008

(65) Prior Publication Data

US 2008/0242167 A1 Oct. 2, 2008

Related U.S. Application Data

(63) Continuation of application No. 10/895,515, filed on Jul. 21, 2004, now Pat. No. 7,361,070.

(60) Provisional application No. 60/492,142, filed on Aug. 1, 2003.

(51) Int. Cl.

| | |
|---|---|
| ***A63B 31/10*** | (2006.01) |
| *A63B 31/00* | (2006.01) |
| *A63B 31/12* | (2006.01) |

(52) U.S. Cl. ..... 441/56; 441/55; 441/58; 441/59

(58) Field of Classification Search ..... 441/55–61; 440/101

See application file for complete search history.

(56) References Cited

U.S. PATENT DOCUMENTS

| | | | | |
|---|---|---|---|---|
| 2,159,972 | A | 5/1939 | Larson | |
| 2,745,119 | A * | 5/1956 | Whipple | 441/56 |
| 2,850,748 | A * | 9/1958 | Read | 441/56 |
| 2,941,218 | A | 6/1960 | Read | |
| 3,978,537 | A | 9/1976 | Shamlian | |
| 4,493,663 | A | 1/1985 | Richmond | |
| 4,521,011 | A * | 6/1985 | Solloway | 482/111 |
| 5,795,201 | A | 8/1998 | Tibbetts | |
| 5,842,896 | A | 12/1998 | Liveoak | |

* cited by examiner

*Primary Examiner*—Lars A Olson
*Assistant Examiner*—Daniel V Venne
(74) *Attorney, Agent, or Firm*—Ganz Law, PC

(57) ABSTRACT

An aquatic propulsion device for holding a hand or foot in a desired position, the device comprising a curvilinear support surface and a linking element arranged across the hand or foot joint at a desired angle to secure the joint in the desired position.

19 Claims, 6 Drawing Sheets

AQUATIC PROPULSION DEVICE FOR SWIMMERS

CROSS REFERENCE TO RELATED APPLICATIONS

This application is a continuation of U.S. patent application Ser. No. 10/895,515, filed Jul. 21, 2004 now U.S. Pat. 7,361,070 entitled "AQUATIC PROPULSION DEVICE FOR SWIMMERS" which claims priority to and the benefit of U.S. provisional patent application No. 60/492,142 entitled "AQUATIC PROPULSION DEVICE," filed Aug. 1, 2003, the entire disclosures of which are hereby incorporated by reference as if set forth in their entirety herein for all purposes.

BACKGROUND OF THE INVENTION

This invention relates to aquatic propulsion systems, particularly to training aids for swimming.

There is an ever-present need for improved aquatic propulsion systems. Such systems may be used to assist in training novice-to-expert swimmers in proper techniques, including the proper positioning of a swimmer's hands for a given swimming stroke, for example, to gain a competitive advantage in professional or amateur swimming events. A propulsion system is also needed to improve swimming technique and thus improve enjoyment of leisure swimming. There is also a need for an aquatic propulsion system that may be worn when swimming to improve efficiency, power, and speed, or to rehabilitate an injured muscle group. There is also a need for a system that will enhance pleasure and improve the effects of swimming as an exercise.

One disadvantage of conventional aquatic propulsion devices is that they do not train the proper hand position or align the hand with other anatomical regions. For example, prior-art devices such as kick boards, swimming fins worn on the feet, paddles for the hands, or flotation devices do not position the hand in proper anatomical alignment for efficient propulsion through the water.

When swimming, the most efficient position of the hand, forearm, fingertips, and elbow is a position that provides a uniform application of force on the pulling surface and an increased surface area for holding water, resulting in the generation of more power and speed. This efficient alignment of the fingertips, hand, forearm, and elbow is generally known as the "paddle-blade position." The paddle-blade position is essential to create the maximum amount of power and speed for each stroke. The prior art does not adequately address training a swimmer to maintain the paddle-blade position throughout the swimming stroke. As a result, many swimmers "break their wrists," that is, lose the paddle-blade position alignment at some point during a swimming stroke. This misalignment results in inefficient swimming technique that may lead to fatigue, reduced power, and speed loss when swimming.

Additionally, the prior art does not train muscle memory of the hand, fingertips, elbow, and forearm.

SUMMARY OF THE INVENTION

The present invention overcomes problems in the prior art by providing a novel aquatic propulsion device that places the anatomy of a swimmer in the paddle-blade position and trains muscle memory of the paddle-blade position. The present invention may also be used to place anatomy in other desired positions that the swimmer may find advantageous. The present invention may be used as a training-aid to improve speed, improve efficiency, reduce fatigue, and enhance pleasure of swimming for novice to professional swimmers.

The present invention contemplates an aquatic propulsion device for holding a hand or foot in a desired position. The device includes a curvilinear support surface, which can align the hand or foot in a position for efficient swimming. The support surface may be secured to the foot or hand. To maintain a fixed relation across the joint, a linking element is linked to the curvilinear support surface at a desired angle.

These and other embodiments are described in more detail in the following detailed descriptions and in the figures.

The foregoing is not intended to be a limiting description of the invention: Persons skilled in the art are capable of appreciating other embodiments and features from the following detailed description in conjunction with the drawings.

BRIEF DESCRIPTION OF THE DRAWINGS

Representative embodiments of the present invention are shown in FIGS. 1 through 8, wherein similar features share common reference numerals.

DETAILED DESCRIPTION OF THE INVENTION

The present invention provides a novel aquatic propulsion system that trains a swimmer's muscles to attain and retain the paddle-blade position. The system according to the present invention introduces a uniquely curved paddle device that can be comfortably worn by a swimmer.

Figure 1A:
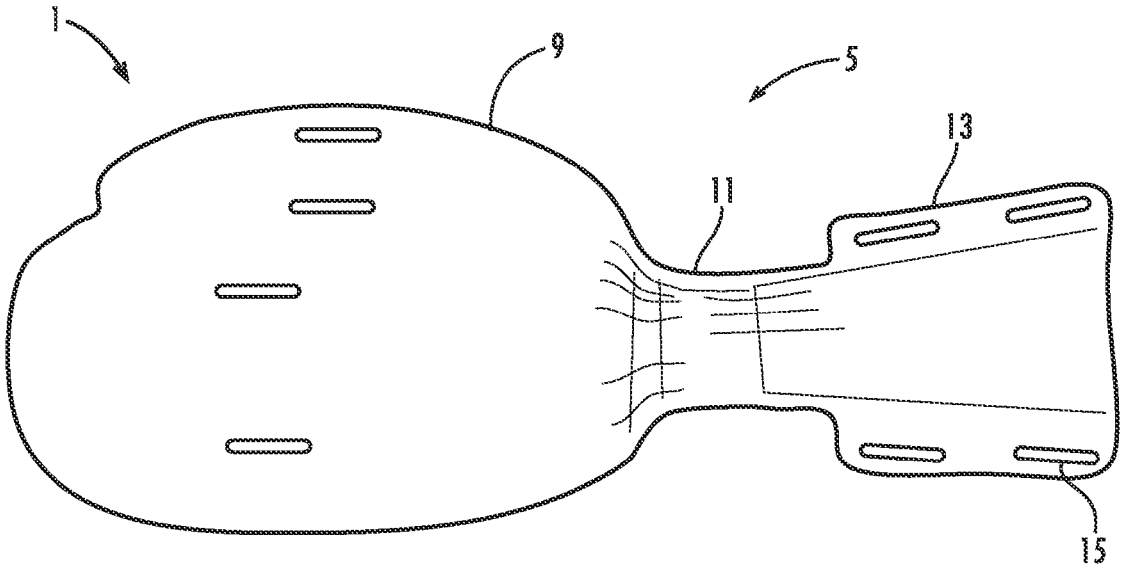
FIG. 1A shows a top view of one embodiment of an aquatic propulsion system for a left hand.
Figure 1B:
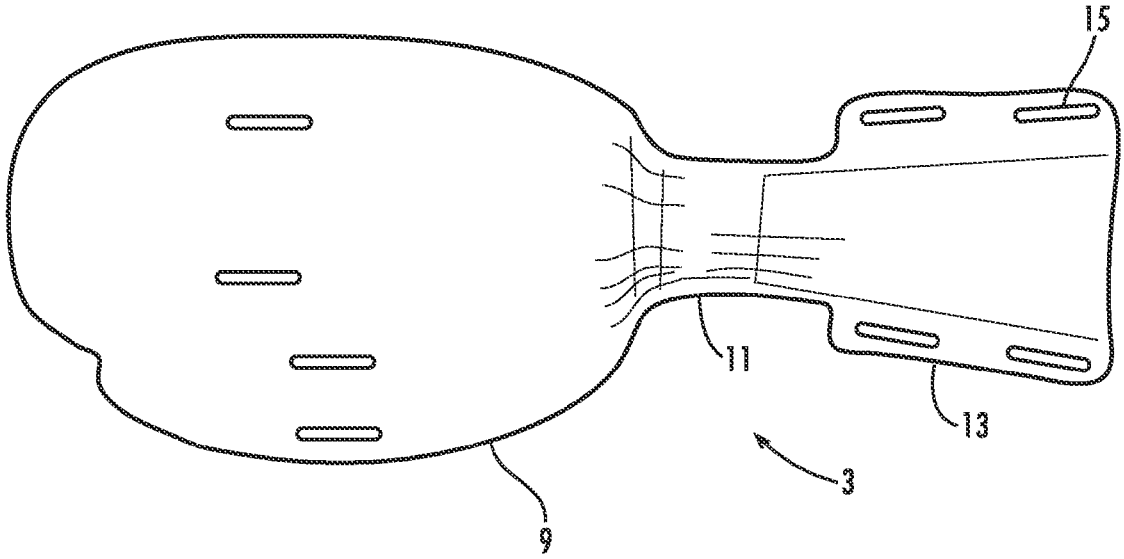
FIG. 1B shows an alternate top view of one embodiment of an aquatic propulsion system for a right hand.

FIGS. 1A, 1B show an aquatic propulsion system 1 according to the present invention. The system 1 may include a first and second propulsion device, such as right paddle 3 and left paddle 5. While this disclosure discusses a pair of propulsion devices, the system 1 of the present invention may also work as a single device. Similarly, while this disclosure discusses distinct right- and left-handed paddle shapes, it is understood that distinct right-hand and left-hand shapes are not an essential aspect of the invention. Some embodiments may employ intermediate shapes suitable for use with either hand, eliminating the need to manufacture and ship unique right-hand and left-hand parts.

Figure 2:
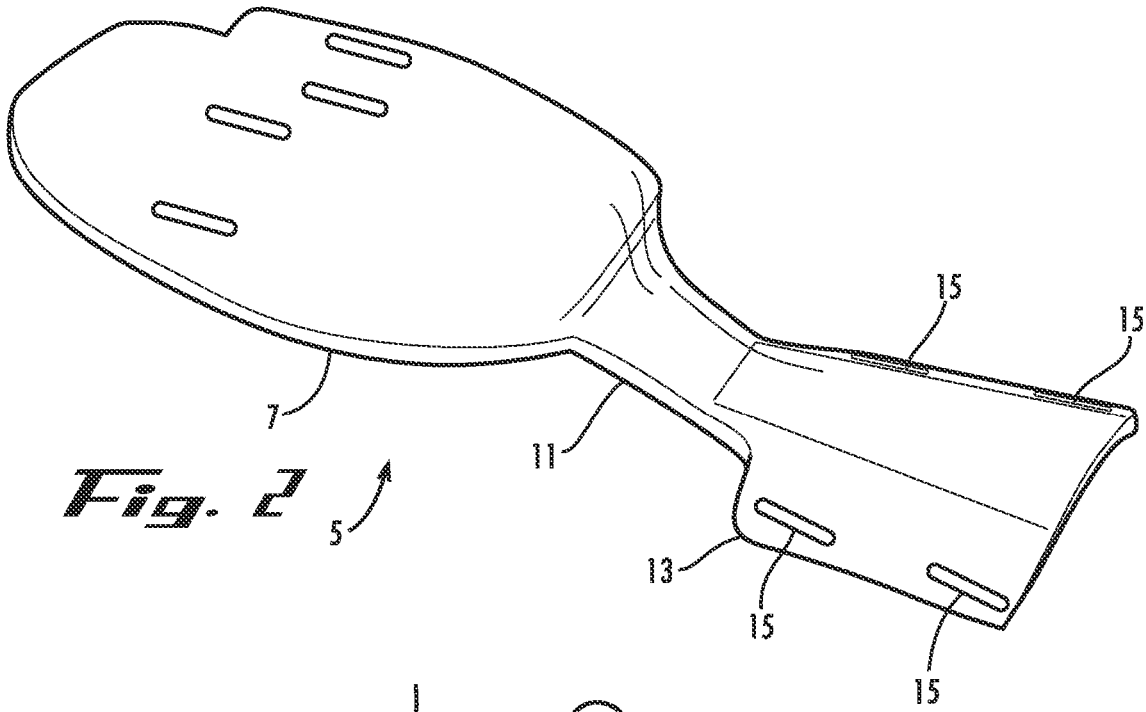
FIG. 2 shows a top perspective view of one device of the system shown in FIG. 1A.
Figure 3:
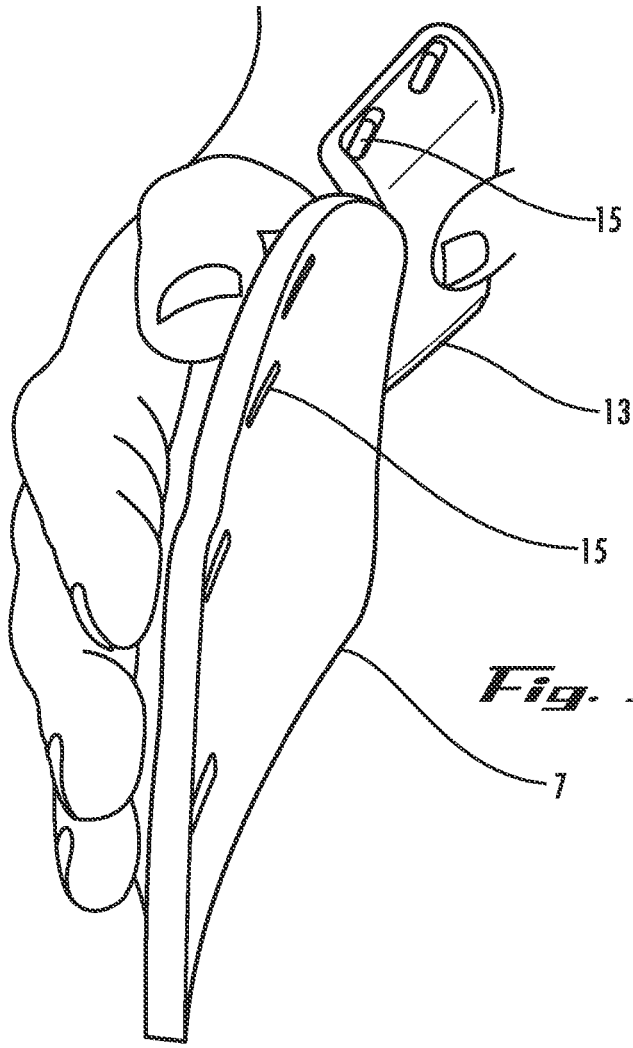
FIG. 3 shows a front perspective view of the embodiment of FIG. 1B.
Figure 5:
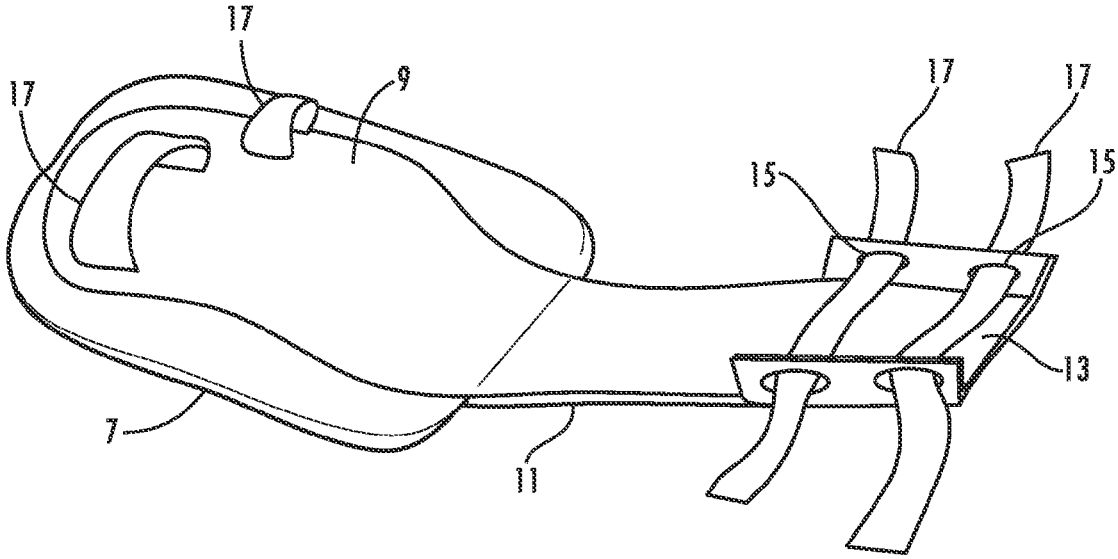
FIG. 5 shows a left side perspective view of an alternative embodiment of the present invention.
Figure 6:
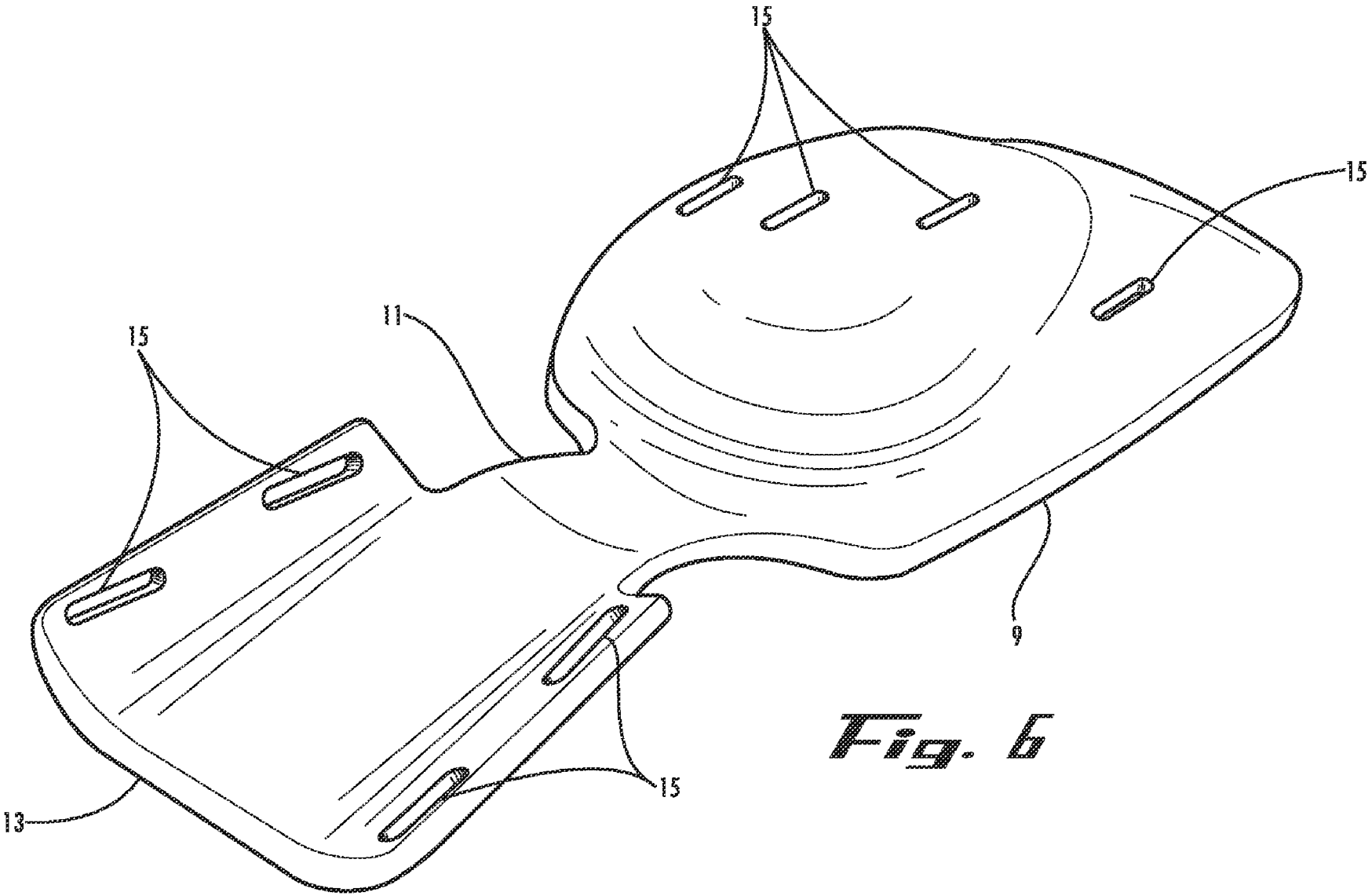
FIG. 6 shows a rear perspective view of a propulsion device as shown in FIG. 1B.
Figure 8:
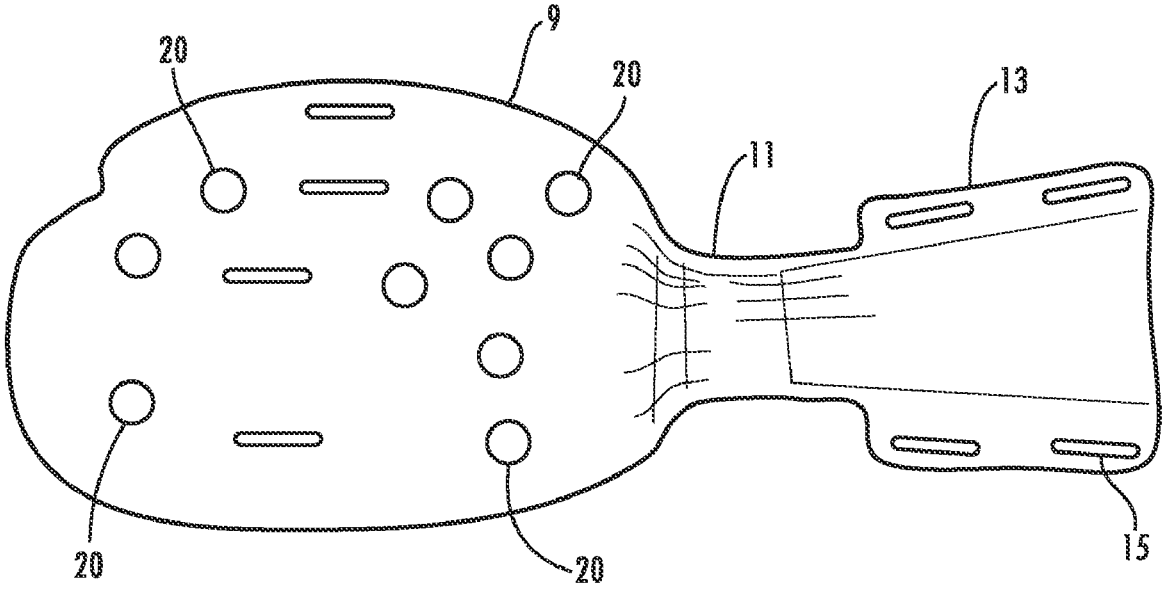
FIG. 8 shows a top view of an embodiment with holes provided in the propulsion surface.

Each device includes a hand support 9 that is generally curvilinear, for example, a convex shape. Opposite the hand support 9 may be a correspondingly curved propulsion surface 7, for example, a concave shape as shown in FIG. 2. Shown in FIG. 3, a hand support 9 has a generally curvilinear profile. The propulsion surface 7 may have any shape or size. For example, the propulsion surface 7 may be substantially planar and have a large surface area as shown in FIG. 5. Also, as shown in FIG. 8, propulsion surface 7 may include any number of holes 20, of any diameter, in any location. The size and number of holes 20 could be selected to vary the amount of resistance against the propulsion surface. These optional features would be useful to develop muscles and endurance, for example, while simultaneously training the swimmer to use the paddle-blade position or other desired position.

The hand support 9 may have slots 15 adapted to receive corresponding securing elements 17, so that a swimmer's hand maybe removably secured to the propulsion surface. For example, one set of slots may be arranged to secure a thumb of a swimmer, while a second set of slots may be positioned to secure the fingers of a swimmer.

A linking element 11 aligns the propulsion surface 7 and hand support 9 in fixed relation to a support platform 13. To place the hand in the paddle-blade position, the fixed relation maintains an acute angle from the mean surface of propulsion surface 7. This linking element 11 may be arranged in relation to the support platform 13 at an angle of about 10 to 15 degrees from horizontal, for example. To place the hand in other desired positions, other non-adjustable angles are within the scope of the invention. Means for adjusting the angle between the linking element 11 and support platform 13 are also within the scope of the present invention, so that a swimmer may manipulate the device into the paddle-blade position or into other desired positions. Contemplated adjustment devices include, without limitation, ratcheting or pivoting devices that let the user change the angle and then lock the selected angle in place during use. Additionally, the length of element 11 may be pre-determined based on the specific anatomy of the swimmer.

The angled linking element is adapted so that a swimmer's anatomy is aligned in the paddle-blade position and connects the hand support to the support platform. This fixed relationship between the hand support 9 and support platform 13 also facilitates securing of the device to the forearm of a swimmer.

One contemplated support platform 13 is a forearm/wrist support as shown in FIGS. 1 through 4. The support 13 may have sets of slots 15 adapted to receive a securing element 17, so that the wrist and forearm of a swimmer may be removably secured to the device 3 or 5. To assist securing, the support 13 may also include opposing upward-sweeping flanges, adapted to cradle a swimmer's forearm and otherwise assist in securing the device to the swimmer. Support 13 may include slots 15 on the upward-sweeping opposing flanges. Although the support 13 is depicted in the figures as having upturned opposing flanges, many other configurations are possible including, for example, exclusion of the flanges. This exclusion would leave a generally planar surface. Also, while a preferred embodiment may include slots 15 in the support surface 13, it is contemplated that other retention means may be used. For example, a strap may simply be fitted around the forearm of the swimmer and encapsulate the securing surface 13.

Figure 4:
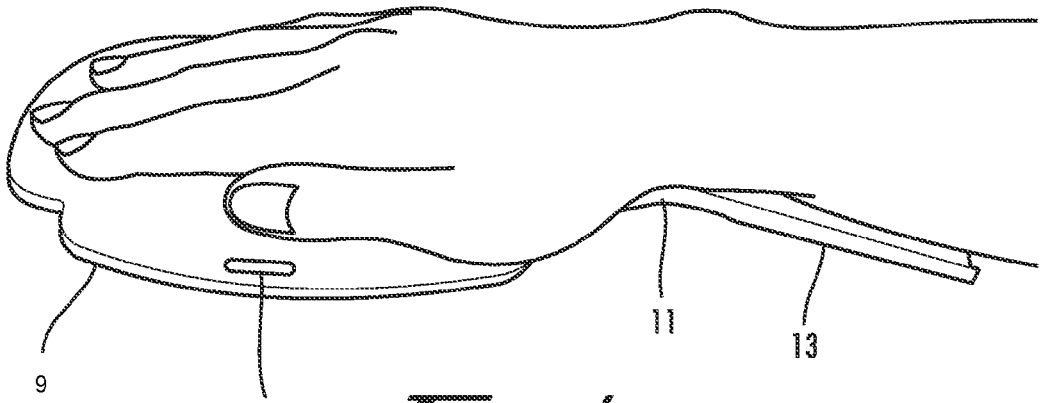
FIG. 4 shows a left side view of the system of FIG. 1B as may be secured to a wearer.

Each element of the device—the hand support 9, the linking element 11, the support platform 13, and securing elements (i.e., straps)—are aligned in relation to each other so that a swimmer's anatomy including the forearm, wrist, hand, and fingertips are aligned in the paddle-blade position when worn. This relationship is depicted in FIG. 4.

Figure 7:
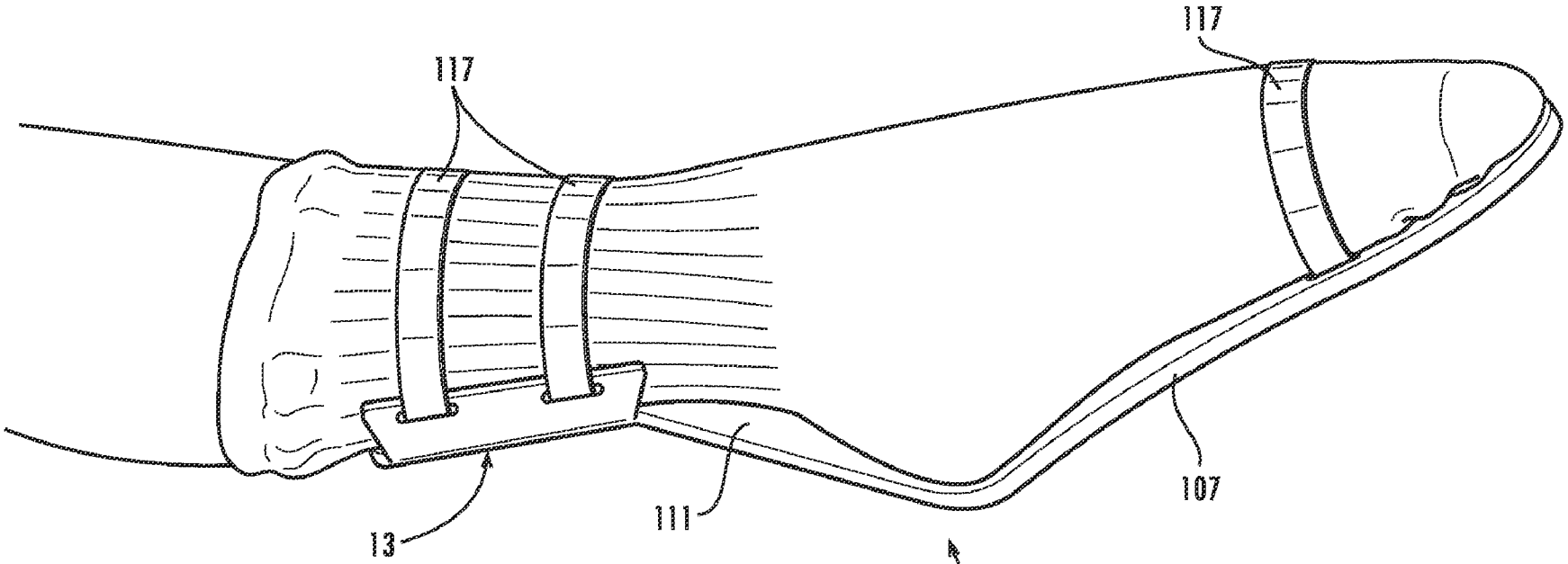
FIG. 7 shows a right side view of an alternative device of the present invention.

In an alternative embodiment, the system of the present invention may additionally, and/or independently, include a swimming aid for the feet. A desired foot position is shown in FIG. 7. This position is desired for efficient swimming. To train and develop muscle memory, a foot device may be similarly configured as the hand device described herein. As such, the foot propulsion device may place the foot, ankle, and lower leg in an efficient swimming position. This position may be termed "the propulsion position."

A device 101 may include an ankle support surface 113 which can be attached to the lower leg of a swimmer by a securing element 117, for example, by straps. The support surface 113 may have flanged edges to facilitate placement and securing on the lower leg. Connected to the support surface 113 by an intermediate member 111 is a footpad 107. The footpad 107 is adapted to receive the foot of a swimmer and is contoured to place the foot in the propulsion position. The footpad 107 may also include a securing element 117 to hold the foot securely against the footpad 107.

The intermediate member 111 connects the footpad 107 to the support 113 at an angle that aligns the lower leg, ankle, and foot in the desired position. In a preferred embodiment, the intermediate member is constructed of a flexible material of sufficient rigidity to maintain the foot and lower leg alignment in the propulsion position during a stroke, but is flexible enough to permit the foot to rotate when required to push off the pool wall when swimming laps, for example. Alternatively, the intermediate member 111 may include a frictional hinge mechanism, which may be adapted to pivotably retain alignment between the footpad 107 and the support 113.

Contemplated material for the device include a rigid or substantially rigid material such as plastic, wood, metal, or a composite material that is water resistant and holds the anatomy in a desired position during use.

One contemplated method of using the present invention includes securing a first the device, such as paddle 3, to one hand of a swimmer. Securing of the paddle may be accomplished by using one or more securing elements 17. The securing elements 17 may be arranged on the device adjacent to the hand support 9. A second set of securing elements 17 may be arranged on the device adjacent the support platform 13. A second paddle 5 may be attached to a second hand by similar means. Then, a swimmer would swim while wearing at least one device. The system would force alignment of the swimmers, fingers, hand, wrist, and forearm, for example, into proper paddle-blade position.

An alternative method of using the present invention includes securing a foot device to the foot and lower leg of a swimmer. A securing support may be used to attach a portion of the foot device 101 to the lower leg. This portion may be a support surface 113. To maintain proper alignment a connecting element 111 may link the support surface 113 to a propulsion surface 107 and foot support 107. Securing elements may be attached to the foot, as well.

Persons skilled in the art will recognize that many modifications and variations are possible in the details, materials, and arrangements of the parts and actions which have been described and illustrated in order to explain the nature of this invention and that such modifications and variations do not depart from the spirit and scope of the teachings and claims contained therein.

What is claimed:

1. An aquatic propulsion device comprising:

a hand support for supporting the hand of a user;

a linking element extending from one side of the hand support across a wrist joint, a forearm/wrist support platform extending from the linking element on a side opposite the hand support for supporting a wrist and forearm of a user;

wherein the linking element is angled upwardly from the hand support to the forearm/wrist support, aligning the forearm/wrist support platform and hand support in a fixed relation that maintains an acute angle from the horizontal relative to the forearm/wrist support; and wherein the device is rigidly constructed over the hand support, linking element and forearm/wrist support so that the hand support and forearm/wrist support do not pivot relative to each other and thereby provide the fixed relation during use.

2. The device of claim 1 wherein the linking element is arranged in relation to the support platform at an angle of about 10-15 degrees from horizontal to place the hand in a paddle-blade position.

3. The device of claim 2 wherein the hand support has a convex hand support surface and a concave propulsion surface.

4. The device of claim 1 wherein the hand support has a convex hand support surface and a concave propulsion surface.

5. The device of claim 1 further comprising one or more securing elements for holding the hand, wrist and forearm in the fixed relation.

6. The device of claim 5 wherein the hand support has a convex hand support surface and a concave propulsion surface.

7. The device of claim 1 wherein the forearm/wrist support has a length that is longer than the length of the linking element.

8. An aquatic propulsion device comprising:

a hand support for supporting the hand of a user;

a linking element extending from one side of the hand support across a wrist joint, a forearm/wrist support platform extending from the linking element on a side opposite the hand support for supporting a wrist and forearm of a user;

wherein the linking element is angled upwardly from the hand support to the forearm/wrist support, aligning the forearm/wrist support platform and hand support in a fixed relation of an acute angle from a mean surface of a propulsion surface of the hand support to fix the hand in the paddle-blade position of about 10-15 degrees from horizontal; and wherein the device is rigidly constructed over the hand support, linking element and forearm/wrist support so that the hand support and forearm/wrist support do not pivot relative to each other and thereby provide the fixed relation during use.

9. A method of making an aquatic propulsion device comprising:

providing an aquatic propulsion device comprising:

a hand support for supporting a hand of a user;

a linking element extending from one side of the hand support across a wrist joint, a forearm/wrist support platform extending from the linking element on a side opposite the hand support for supporting a wrist and forearm of a user;

wherein the linking element is angled upwardly from the hand support to the forearm/wrist support, aligning the forearm/wrist support platform and hand support at an angle of about 10-15 degrees from horizontal to place the hand in the paddle-blade position;

wherein the device is rigidly constructed over the hand support, linking element and forearm/wrist support so that the hand support and forearm/wrist support do not pivot relative to each other and thereby provide the fixed relation during use; and providing one or more securing elements for removably securing the device to a user's hand and forearm.

10. An aquatic propulsion device comprising:

a hand support for supporting the hand of a user;

a linking element extending from one side of the hand support across a wrist joint, a forearm/wrist support platform extending from the linking element on a side opposite the hand support for supporting a wrist and forearm of a user wherein the linking element is angled relative to the hand support and the forearm/wrist support platform, aligning the forearm/wrist support platform and hand support in a fixed relation that maintains an acute angle from the horizontal relative to the forearm/wrist support;

wherein the device is rigidly constructed over the hand support, linking element and forearm/wrist support so that the hand support and forearm/wrist support do not pivot relative to each other and thereby provide the fixed relation during use; and wherein the hand support has a width corresponding to the width of a user's hand and the linking element has narrower width than the hand support, corresponding to a user's wrist.

11. The device of claim 10 wherein the forearm/wrist support platform has a width wider than the linking element, corresponding to the width of a user's forearm.

12. The device of claim 10 wherein the linking element is arranged in relation to the forearm/wrist support platform at an angle of about 10-15 degrees from horizontal to place the hand in a paddle-blade position.

13. The device of claim 12 wherein the forearm/wrist support platform has a width wider than the linking element, corresponding to the width of a user's forearm.

14. The device of claim 12 wherein the hand support has a width corresponding to the width of a user's hand and the linking element has narrower width than the hand support, corresponding to a user's wrist.

15. The device of claim 12 wherein the hand support has a convex hand support surface and a concave propulsion surface.

16. The device of claim 10 further comprising one or more securing elements for holding the hand, wrist and forearm in the fixed relation.

17. The device of claim 10 wherein the hand support has a convex hand support surface and a concave propulsion surface.

18. The device of claim 17 further comprising one or more securing elements for holding the hand, wrist and forearm in the fixed relation.

19. An aquatic propulsion device comprising:

a hand support for supporting the hand of a user a linking element extending from one side of the hand support across a wrist joint, a forearm/wrist support platform extending from the linking element on a side opposite the hand support for contacting and supporting both a wrist and forearm of a user, wherein the forearm/wrist support has a length that is longer than the length of the linking element;

wherein the linking element is angled relative to the hand support and the forearm/wrist support platform, aligning the forearm/wrist support platform and hand support in a fixed relation that maintains an acute angle from the horizontal relative to the forearm/wrist support; and wherein the device is rigidly constructed over the hand support, linking element and forearm/wrist support so that the hand support and forearm/wrist support do not pivot relative to each other and thereby provide the fixed relation during use.

* * * * *